United States Patent [19]

Oshima et al.

[11] 4,305,352

[45] Dec. 15, 1981

[54] INTERNAL COMBUSTION ENGINE

[75] Inventors: Yujiro Oshima, Ishinomiya; Takatoshi Banno, Nagoya, both of Japan

[73] Assignee: Kabushiki Kaisha Toyota Chuo Kenkyusho, Aichi, Japan

[21] Appl. No.: 947,304

[22] Filed: Sep. 29, 1978

[30] Foreign Application Priority Data

Sep. 30, 1977 [JP] Japan ..... 52-118401

[51] Int. Cl.[3] ..... F01L 1/34

[52] U.S. Cl. ..... 123/90.15; 123/90.31; 123/146.5 A; 123/192 B; 123/501

[58] Field of Search ..... 123/90.15, 90.16, 90.17, 123/90.31, 90.6, 139 AP, 139 AQ, 192 B, 146.5 A, 90.27, 501

[56] References Cited

U.S. PATENT DOCUMENTS

| | | | |
|---|---|---|---|
| 1,061,098 | 5/1913 | McKeen, Jr. | 123/90.15 |
| 1,220,124 | 3/1917 | Hoffner | 123/146.5 A |
| 1,358,186 | 11/1920 | Brewer | 123/90.15 |
| 2,685,281 | 8/1954 | MacGregor | 123/90.15 |
| 2,780,912 | 2/1957 | Miller | 123/90.16 |
| 3,181,520 | 5/1965 | Mock | 123/139 AP |
| 3,369,532 | 2/1968 | McIlroy | 123/90.16 |
| 3,416,502 | 12/1968 | Weiss | 123/90.15 |
| 3,800,625 | 4/1974 | Seino et al. | 123/192 B |

FOREIGN PATENT DOCUMENTS

| | | | |
|---|---|---|---|
| 2338501 | 2/1975 | Fed. Rep. of Germany | 123/139 AP |

*Primary Examiner*—Craig R. Feinberg
*Assistant Examiner*—W. R. Wolfe
*Attorney, Agent, or Firm*—Blum, Kaplan, Friedman, Silberman and Beran

[57] ABSTRACT

An internal combustion engine is so constructed that the timing of the intake and exhaust valves can be changed during operation of the engine making it possible to select the optimum timing for the valves in accordance with the operating conditions. The timing can be changed from the exterior of the engine on the basis of factors such as the quantity and nature of pollutants in the exhaust gases, the rate of revolution of the engine and the load on the engine. Adjustment can be effected either manually or automatically.

The construction of the engine is such that the cam shaft or cam shafts can be replaced with cam shafts of a different design and that the cylinder head can be replaced with a head of a different design.

Adjustment of the timing of the intake and exhaust valves is effected through the use of a planetary gear train which also provides the necessary reduction in the speed of the cam shaft relative to the crank shaft.

The engine is suitable for operation of a practical automobile or as a research and development device.

19 Claims, 25 Drawing Figures

FIG. 21a
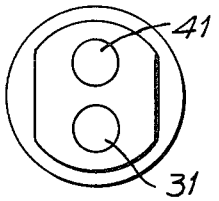
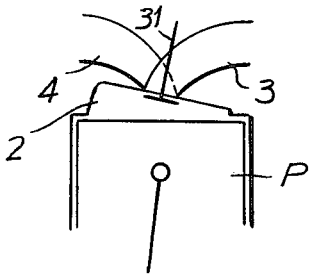
FIG. 21b
FIG. 22a
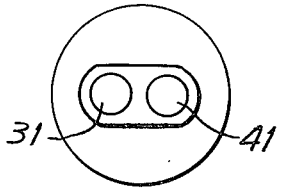
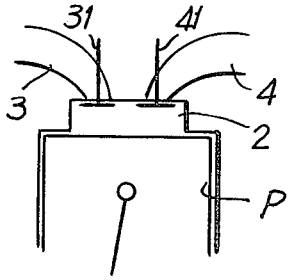
FIG. 22b
FIG. 23
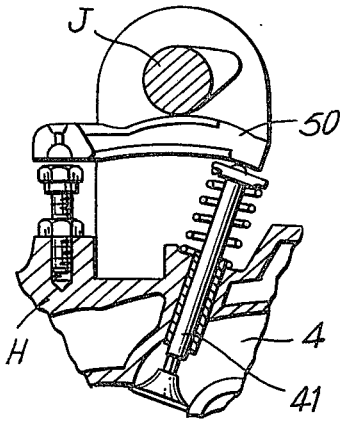

INTERNAL COMBUSTION ENGINE

BACKGROUND OF THE INVENTION

The present invention relates to an internal combustion engine suitable both for powering a vehicle and for research and development directed toward reduction of fuel consumption, reduction of pollutants and improvement of performance. The approach to these objectives is by way of a construction which makes it possible to control the timing and the overlap of both the intake and exhaust valves. Adjustment of these variables can be effected during operation of the engine either manually or automatically, using a detecting device for monitoring the performance of the engine, particularly with respect to fuel consumption and the amount of nitrogen oxides contained in the exhaust gases. A feature of substantial advantage is that the reduction in speed between crank shaft and cam shaft is effected by the same apparatus which provides for control of the valve timing and that both the reduction in speed and control of the valve timing are carried out with minimal power loss through friction.

In prior art internal combustion engines it has been the practice to drive the cam shaft by way of a gear formed integrally with the crank shaft, power being transmitted to the cam shaft either through a drive chain or another gear, and it has been impossible to change the rotational phase of the cam shaft with respect to the crank shaft. In view of the fact that the quantity of detrimental components in the exhaust gases and the fuel consumption of the engine depend upon the valve timing and upon the valve overlap, demands have recently arisen for an engine in which these functions could be varied. In a course of studies directed toward the development of an internal combustion engine in which the quantity of pollutants in the exhaust gases and in which the fuel consumption could be reduced, the present inventors have found that both fuel consumption and the quantity of nitrogen oxides in the exhaust gases could be reduced by changing the rotational phase of a cam shaft relative to the crank shaft in accordance with the load exerted on the engine.

As a result of this finding, it has been earnestly desired to provide an internal combustion engine which could provide for precise and easy control of the aforenoted variables and which, in addition, could easily be modified for investigation of the effect of combustion chamber configuration, type of valve-operating mechanism, modification of cam shape and number of cam shafts. Also, it should be possible to determine frictional loss, effects of operating temperature, special lubrication and any other pertinent factors which might be discovered.

There has been, as yet, no internal combustion engine which is really satisfactory for testing use, that is, for research and development. For instance, a change in the contour or type of combustion chamber may lead to requirement for a change in the positioning of valves or a change in the inclination of the valves, thus requiring a change in the positioning or contour of a cam shaft for operating either the intake valves or exhaust valves as well as remodeling of the driving portions for the respective valves. However, in conventional test engine constructions, interchange of cylinder heads to provide for a difference in contour and type of combustion chamber and positioning of valves is relatively difficult, making it impractical to carry out such tests so that the effect of such variables on performance cannot readily be determined. Moreover, where a serious attempt is made to carry out such tests, the resulting construction must be complex and the engine itself must be of substantially increased size, further increasing the difficulty of disassembling and reassembling the engine for each test. As is evident then, there has been a substantial need for an internal combustion engine which can serve as a practical device for powering a vehicle as well as other devices and which can also serve as a major piece of test equipment for research and development on the effect of intake and exhaust valve timing as well as other factors on fuel consumption, production of pollutants and general performance of internal combustion engines.

SUMMARY OF THE INVENTION

An internal combustion engine in accordance with the present invention comprises a planetary gear train for providing both speed reduction between the crank shaft and a cam shaft and continuously variable control of valve timing and valve overlap while the engine is in operation. The planetary gear train includes a sun gear, planet gears engaging the sun gear and an internal gear also engaged by said planet gears. The planet gears are held in a carrier which can be rotated relative to the sun gear for changing the phase of the internal gear relative to the sun gear.

In a first embodiment of the invention, two separate overhead cam shafts are driven by a timing chain powered by the crank shaft. In a second embodiment of the invention two cam shafts, each being provided with a separate planetary gear train, operate overhead intake and exhaust valves through valve lifters and rocker arms.

A preferred means of changing the orientation of the carrier of the planet gears is by way of a worm gear operable from the exterior of said engine, either manually or automatically. A detection device for sensing and monitoring performance variables is provided. Manual control can be effected on the basis of information provided by said detection and monitoring device. Preferably, said detection and monitoring device is arranged and constructed for automatic control of the position of the carrier. A preferred means of connection between the external control means and the worm gear is by way of a cable and link attached to the worm gear.

The gears in the planetary gear trains are sized to provide a desired speed reduction from the crank shaft to the cam shafts.

Injection shafts and timing ignition shafts connected with the cam shaft provide for control of the variables.

The cylinder head is readily removable so that cylinder heads with different configurations of the combustion chamber may be fitted to the block. Also, removal of a bolt makes it possible to remove and replace a cam shaft. The cam shaft housing is such that it can be rotated around the cam shaft, thereby making it possible to determine the effect of the angle of inclination of the push rods which operate the rocker arms on the performance of the engine.

The engine can be constructed with any number of cylinders from one to six or eight. Balancing weights for neutralizing vibration of the crank shaft can be mounted to the engine.

Accordingly, it is an object of the present invention to provide an internal combustion engine having compact and simple construction by which fuel consumption and the amount of nitrogen oxides in exhaust gases are largely reduced.

Another object of the present invention is to provide an internal combustion engine comprising an adjusting means which changes the rotational phase of a cam shaft to a crank shaft and adjusts the timing of an intake valve and an exhaust valve.

An important object of the present invention is to provide an internal combustion engine comprising an adjusting means which adjusts the timing of an intake valve and an exhaust valve and reduces the rotational speed of the cam shaft to the crank shaft efficiently.

A further object of the present invention is to provide an internal combustion engine further comprising a valve operating device which adjusts the acting angle of a cam shaft to an intake valve and an exhaust valve so that the intake valve and the exhaust valve may be closed or opened at a given acting angle.

Yet another object of the present invention is to provide an internal combustion engine for testing use, wherein the combustion chamber, valve placement, ignition timing, fuel injection timing and valve timing can be changed freely.

A significant object of the present invention is to provide an internal combustion engine for testing use having versatility, durability and reliability over wide operating regions.

A particularly significant objective of the present invention is to provide the aforenoted objects through the use of a planetary gear train controlled either manually or automatically on the basis of information provided by a detecting device which detects and monitors the performance of the engine.

Another particularly significant object of the present invention is an internal combustion engine in which adjustment of the operating conditions, including change in the timing of the intake and exhaust valves, can be effected while the engine is running.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 21*a* and 21*b* are respectively top and bottom views of a cylinder head construction in accordance with the invention;

FIGS. 22*a* and 22*b* are respectively top and bottom views of another cylinder head construction in accordance with the invention; and FIG. 23 is a partial sectional view of a valve mechanism in accordance with the present invention.

DESCRIPTION OF THE PREFERRED EMBODIMENTS

The aforenoted objects are attained by means of an internal combustion engine which includes a valve-operating mechanism so arranged as to freely set and change, even during operation of the engine, the timing of an intake valve and an exhaust valve and the valve overlap, and to reduce the speed of the cam shaft relative to that of the crank shaft, these changes in the above variables being effected for reducing fuel consumption and the quantity of nitrogen oxides contained in the exhaust gases. The internal combustion engine provided by the present invention is compact and simple and can be put to practical use. The reduction in speed of the cam shaft is carried out accurately and efficiently and without serious loss of power due to friction.

Furthermore, there is provided in accordance with the present invention an internal combustion engine for testing use intended for development of an engine which comprises a valve-operating mechanism including, in addition to the aforenoted valve-adjusting device, a valve-operating device for adjusting the acting angle of a cam shaft with respect to the intake valve and the exhaust valve so that the intake valve and the exhaust valve may be brought to an open or closed position at a given acting angle, thereby facilitating the interchange of cylinder heads having different inclinations and positioning of valves and enabling the disposition of a combustion chamber of any desired configuration suitable for application purposes.

Figure 1:
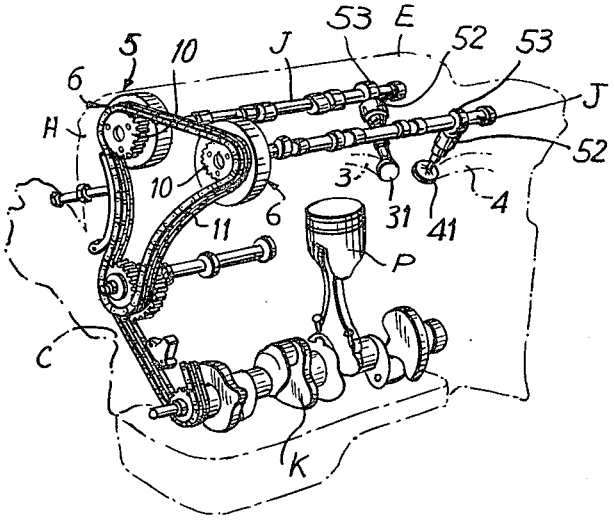
FIGS. 1 through 3 are respectively a perspective view, a cross-sectional view, and an enlarged cross-sectional view of the essential part of the internal combustion engine according to the first embodiment of the present invention.
Figure 2:
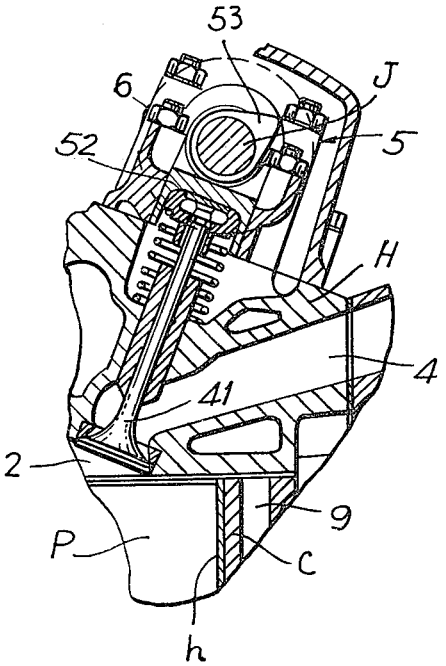
Figure 3:
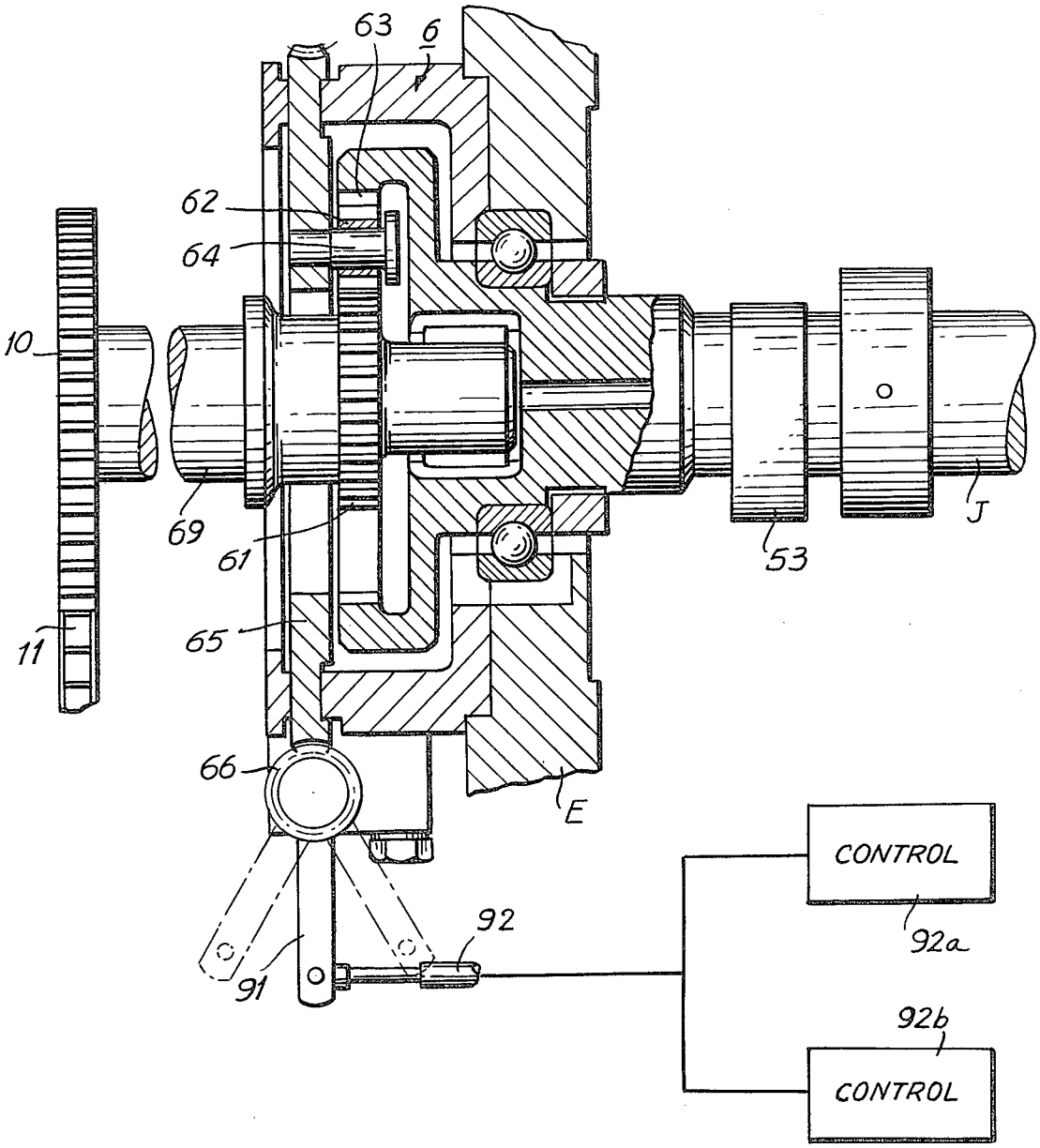

A first embodiment of the present invention will be described in conjunction with FIGS. 1 through 9, wherein an internal combustion engine within the scope of the present invention is realized in a four-cylinder gasoline engine which can be used on an industrial basis. In FIG. 1, an engine body E includes a cylinder block C, a cylinder head H, a piston P and components to be described below. Mounted in cylinder block C are a crank shaft K and cam shafts J for an intake valve and an exhaust valve, both of which are interconnected by way of timing gears 10 and a timing chain 11. In FIG. 2, reference numeral 2 indicates a combustion chamber defined by cylinder block C and cylinder head H. An intake passage 3 (FIG. 1) provides for supplying an air-fuel mixture charge to combustion chamber 2 through intake valve 31. Burned gases are discharged from combustion chamber 2 through exhaust valve 41 and exhaust passage 4. Double-overhead cam shaft 5 is of the direct-acting type and operates the valves. Each such cam shaft is provided with a valve-lifter 52 serving as interlocking portion. Each valve lifter 52 is in engagement at one end thereof with cam 53 on cam shaft J and at the other end thereof with intake valve 31 or exhaust valve 41. Reference numeral 6 in FIGS. 2 and 3 indicates an adjusting device for adjusting the timing at which intake valve 31 and exhaust valve 41 are brought either to open or closed position. Adjusting device 6 also reduces the speed of cam shafts J relative to that of crank shaft K. As can be seen in FIG. 3, adjusting device 6 is disposed in the side portion of engine body E in a manner such that the angular position of the cam shaft J relative to that of the crank shaft K is adjustable, thereby providing the control of the timing at which the intake valve 31 and the exhaust valve 41 are brought to open and closed positions. The adjusting device 6 includes a planetary gear train consisting of a sun gear 61, planet gears 62, internal gear 63 and a carrier 64 rotatably supporting planet gears 62 for turning said planet gears around the sun gear 61 along the inner periphery of the internal gear 63. The cam shaft J is coupled to the inner face of the internal gear 63 coaxially so as to rotate integrally therewith. The planet gear 62 is rotatably secured by a fixing means to the wall portion of the engine body E. The sun gear 61 is driven in synchronism with crank shaft K. Planet gear 62, while revolving, can be rotated by worm wheel 65 and worm gear 66 which are associated with planet gear 62 and serve as the external force-receiving means, whereby the angular position of each cam shaft J relative to the crank shaft K may be changed, such change in the relative angular position providing for control of the timing of the intake valve 31 and the exhaust valve 41.

Worm gear 66 is interconnected by way of link 91 and cable 92 to a control device indicated as **92*a* and 92*b* in FIG. 3, said control device operating in response to such factors as change in the opening angle of a throttle valve, the level of intake vacuum, rotational speed of the engine, exhaust gas temperature, engine load and the nature and quantity of detrimental components in the exhaust gases. Control device 92*a* provides for detection and monitoring of the aforenoted variables and manual adjustment of the adjustment device 6. Control device 92*b* provides for detection and monitoring of the same variables and automatic control of adjustment device 6**.

The planetary gear train comprises reduction gears for each cam shaft J and for desired reduction in speed of the cam shaft relative to the crank shaft, the desired ratio being ½. More specifically, for one revolution of the crank shaft K, timing gears 10 and timing shaft 69 each move through one-half revolution.

In the internal combustion engine according to the first embodiment, a fuel injection system comprises an injection-adjusting device 600 (FIG. 8) including a planetary gear train of construction similar to that described in connection with the cam shafts. In addition, it comprises an ignition system which includes an ignition-adjusting device 700 (FIG. 9) based on a planetary gear train as described above. Thus, both injection timing and ignition timing are adjustable in accordance with the various operating conditions of the engine.

The fuel injection system and the ignition system of the present invention will now be explained in detail. Injection-adjusting device 600 is mounted on the timing shaft 69 of the adjusting device 6 of the intake valve 31 onto the left thereof, as viewed in FIG. 8. The injection-adjusting device 600 includes a planetary gear train comprising a sun gear 610, planet gears 620, an internal gear 630 and a carrier 640 rotatably supporting the planet gears 620, and rotating the same around the sun gear 610 along the inner periphery of the internal gear 630. The central portion of the side end of the internal gear 630 is coaxially connected with a rotating shaft j which is driven in association with a pump shaft of a fuel pump (not shown) so as to rotate integrally therewith. The planet gear 620 is fixed to the wall portion of the engine body E rotatably through a fixing means. The sun gear 610 is driven in synchronism with the crank shaft K and the rotating shaft j is driven through the planetary gear train. The relative angular position of the rotating shaft j to the crank shaft K is changed by turning the planet gears 620 by a second external force-receiving means including a worm wheel 650 and a worm gear 660 provided in association with the planet gears 620. As a result, the fuel injection timing of a fuel injection valve can be controlled. The second external force-receiving means is interconnected to a control device as shown in FIG. 3 for responding to the variation of the opening angle of throttle valve, intake vacuum, etc. through a link and a wire so as to automatically adjust the fuel injection timing corresponding to the driving conditions of the internal combustion engine. Control can also be effected by turning worm gear 660 manually.

Furthermore, by setting the gear ratio of the sun gear 610 to the internal gear 630 to ½, the speed of the rotating shaft J can be reduced to one-half that of the crank shaft K. Thus, the planetary gear train of the fuel injection adjusting device 600 also carries out the speed-reducing function of the rotating shaft j.

According to the injection-adjusting device 600, since the fuel injection timing of the fuel injection valve can be advanced or delayed, the fuel injection can be supplied at a timing corresponding to the various driving conditions of the internal combustion engine E so that the combustion can be effected completely. As a result, the internal combustion engine can be driven smoothly and stably with improved purification of exhaust gas, fuel consumption and output.

Figure 9:
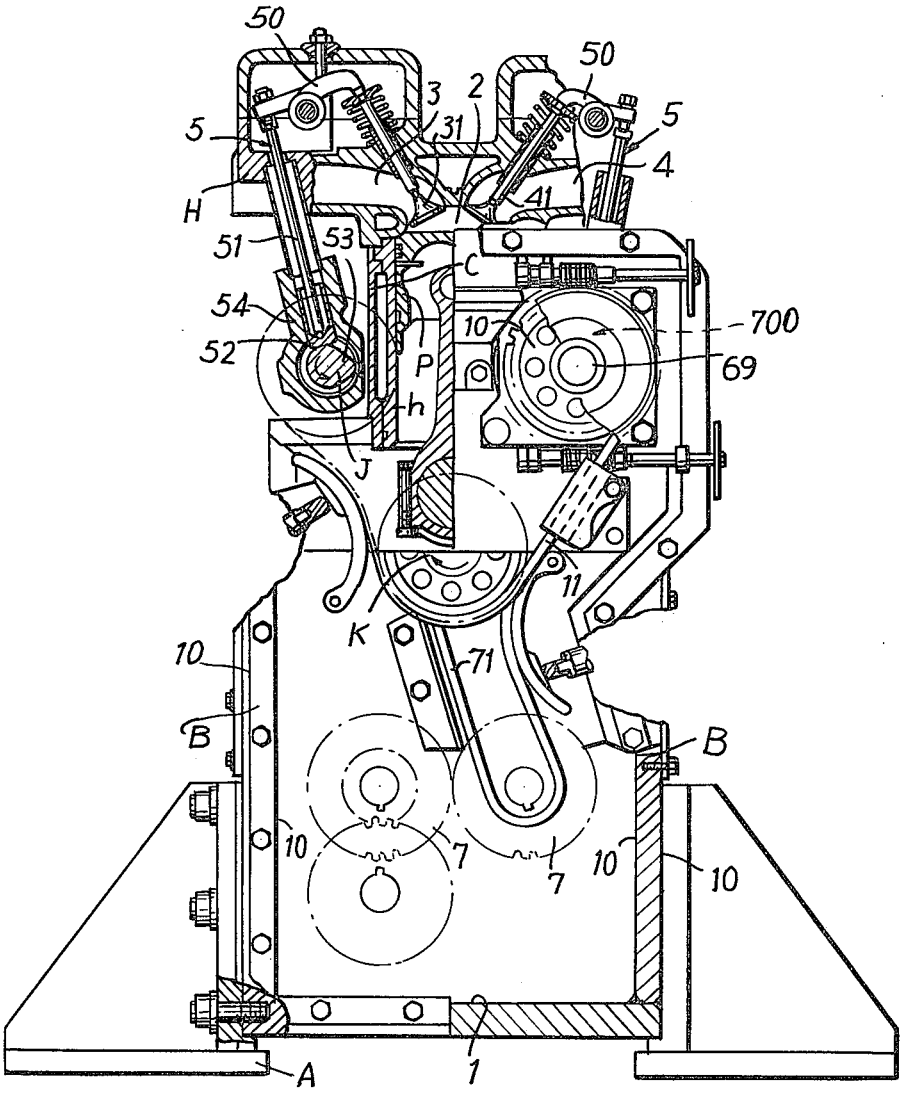

Ignition-adjusting device 700 is mounted on the timing shaft 69 of the adjusting device 6 of the exhaust valve 41 in the opposite side thereof as shown in FIG. 9. The ignition-adjusting device 700 includes a planetary gear train comprising a sun gear, planet gears, an internal gear and a carrier rotatably supporting the planet gears and rotating the same around the sun gear along the inner periphery of the internal gear. The central portion of the side end of the internal gear is coaxially constructed with a rotating shaft of the ignition system so as to rotate integrally therewith.

The planet gears are fixed to the wall portion of the engine body E rotatably through a fixing means. The sun gear is driven is synchronism with the crank shaft K and the rotating shaft is driven through the planetary gear train. The relative angular position of the rotating shaft to the crank shaft K is changed by turning the planet gears by a third external force receiving means including a worm wheel and a worm gear provided in association with the planet gears. As a result, the ignition timing can be controlled.

The third external force-receiving means is interconnected to the control device responding to the variation of the opening angle of a throttle valve, intake vacuum, etc. through a link and a cable so as to automatically adjust the ignition timing corresponding to the driving conditions of the internal combustion engine. In addition, the ignition timing can be controlled manually by turning the worm gear manually.

Furthermore, by setting the gear ratio of the sun gear to the internal gear to ½, the speed of the rotating shaft can be reduced to one-half that of the crank shaft K. Thus, the planetary gear train of the ignition adjusting device also carries out the speed-reducing function of the rotating shaft.

According to the ignition-adjusting device 700, since the ignition timing can be advanced or delayed, the ignition of air-fuel mixture can be effected at a timing corresponding to the various driving conditions of the internal combustion engine E so that the combustion of the engine can be effected completely.

As a result, the internal combustion engine of the present invention can be driven smoothly and stably with improved purification of exhaust gas, fuel consumption and output.

Figure 8:
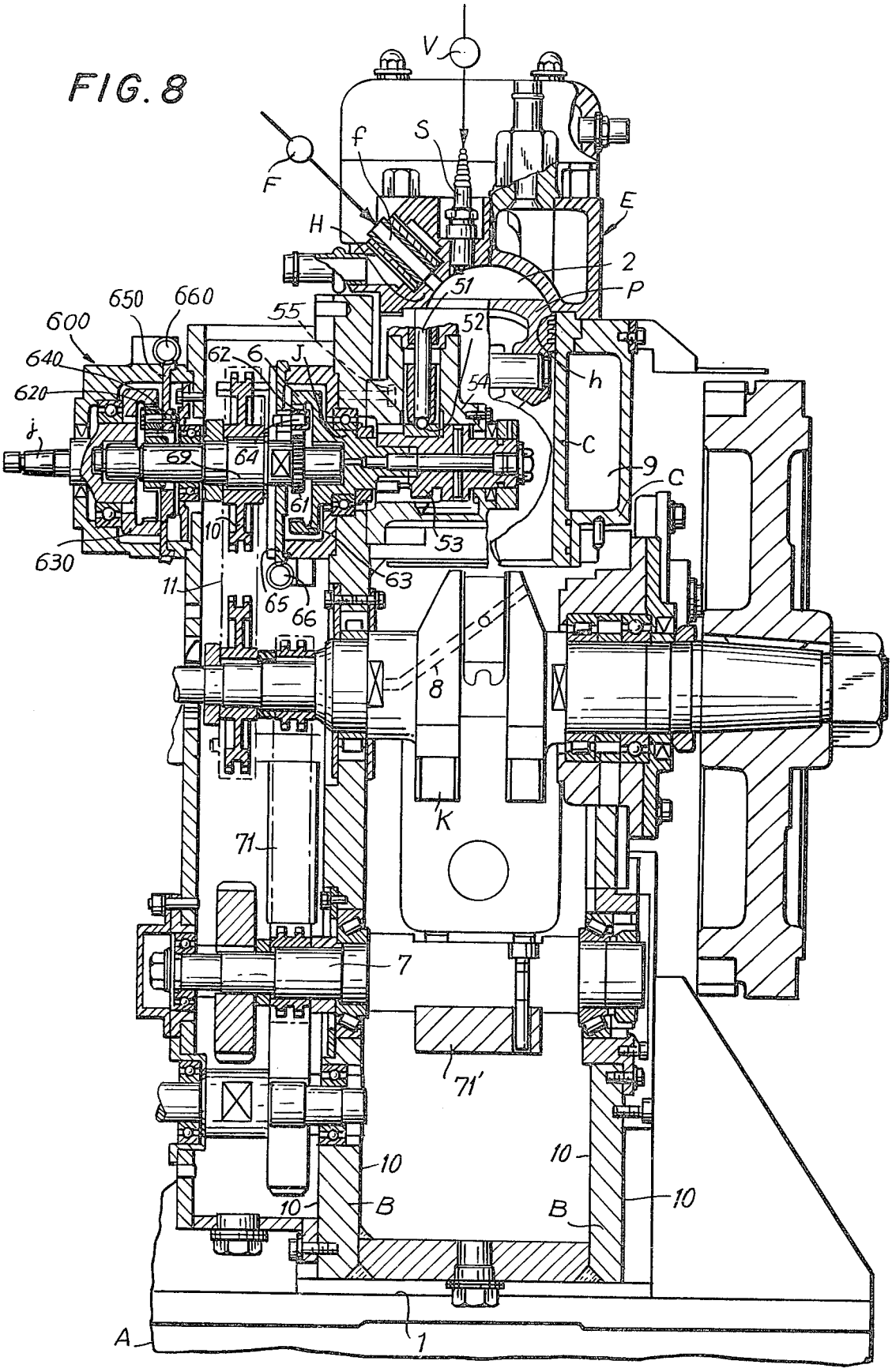
FIGS. 8 through 10 are respectively a partially cutaway front view, a side view and an enlarged cross-sectional view of the essential parts of the internal combustion engine according to a second embodiment.

The engine also includes a lubricating system similar to that shown diagrammatically in FIG. 8 and indicated by the reference numeral 8. It also includes a cooling system 9 as shown in FIG. 2.

Figure 4:
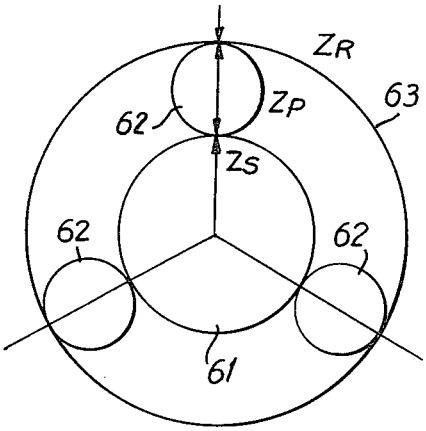
FIGS. 4 and 5 are diagrammatic views of the mode of operation of a timing phase-adjusting device incorporated in said first embodiment.
Figure 5:
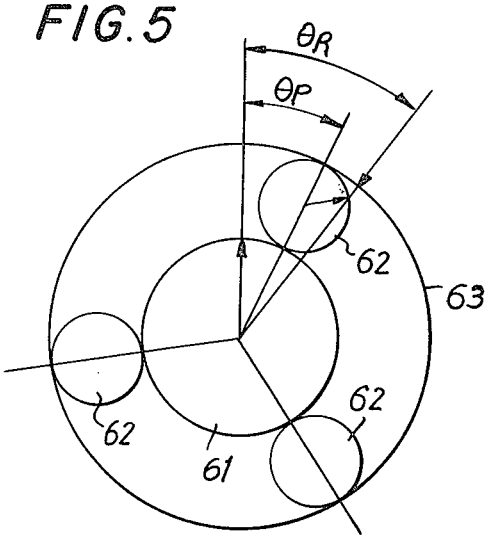

Adjustment of the timing at which the intake valve 31 and the exhaust valve 41 are brought to open or closed position is accomplished with ease and accuracy by adjusting device 6 which is operated by detecting device 92*a* or 92*b* in response to a change in the opening angle of a throttle valve or the level of intake vacuum or other pertinent variables. If planet gear 62 is maintained in fixed position, adjusting device 6 carries out the function of speed reduction from the crank shaft to the cam shafts. If planet gear 62 is rotated by an amount $\theta_p$ as shown in FIGS. 4 and 5, then internal gear 63 on cam shaft J is rotated to the extent of $\theta_R$ relative to sun gear 61. By this means, the phase of cam shaft J with respect to crank shaft K can readily be changed through 360° during the operation of the engine.

Since a planetary gear train, namely adjusting device 6, is provided for each of cam shafts J and K, the timing of intake valve 31 and of exhaust valve 41 may be set independently from each other, and the degree of overlap of the opening periods of the valves may be either increased or decreased.

A particularly important advantage of the adjusting device 6 is that the planetary gear train is small in diametrical size as compared with ordinary reduction gears which generally consist of spur gears or helical spur gears so that the device is both compact and simple.

Figure 6:
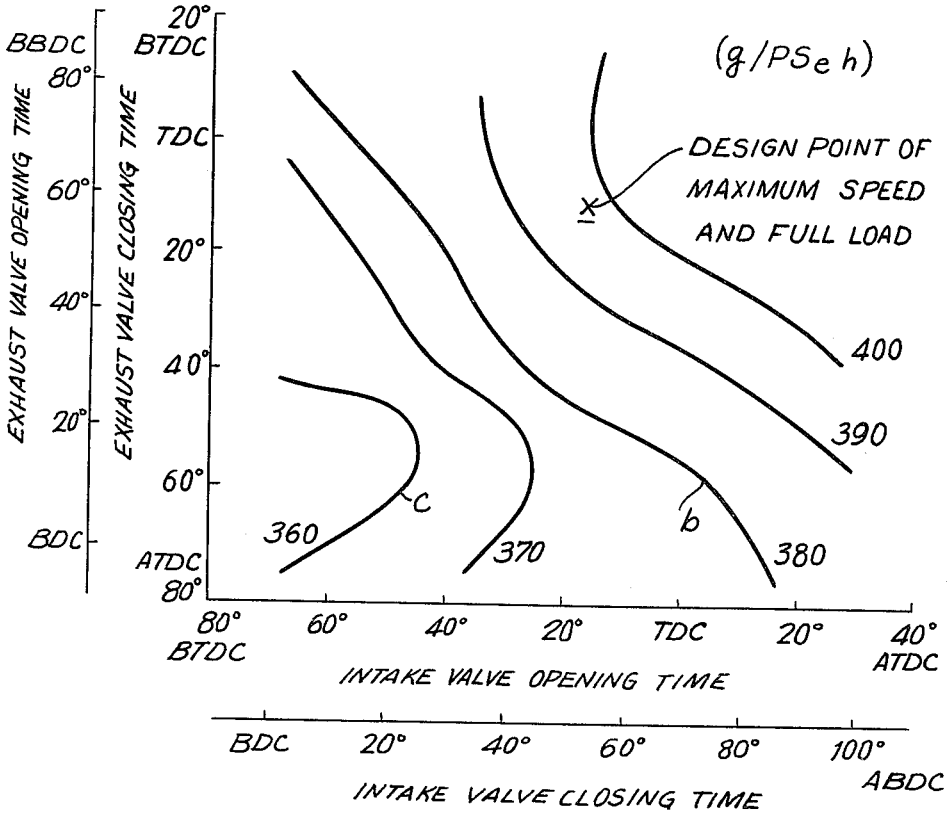
FIGS. 6 and 7 are line graphs showing, respectively, fuel consumption and the quantity of nitrogen oxides contained in exhaust gases versus the timing at which valves are brought to an open or closed position in the respective operating regions of the engine according to the first embodiment.

The brake specific fuel consumption per unit hour and unit brake horsepower of the internal combustion engine in accordance with the first embodiment is shown in FIG. 6, the data corresponding to a selected operating region at 2,000 rpm and full load. As is conventional, the coordinates are given in degrees before and after top dead center and bottom dead center. Moreover, since, for a given cam, the phase angle between opening and closing is fixed, a single axis can be used for showing both the opening and the closing time of the particular valve. The abscissa of the graph of FIG. 6 gives the timing for the intake valve and the ordinate gives the data for the exhaust valve. The fuel consumption of the first embodiment of the internal combustion engine when the operating conditions of the engine correspond to those of an ordinary engine is indicated by the point given the reference character x. The brake specific fuel consumption at this point is 400 g/PS$_e$h. A first adjustment of the timing of the intake valve 31 and the exhaust valve 41 by means of adjusting device 6 so as to control the valve overlap reduces the brake specific fuel consumption to 380 g/PS$_e$h as represented by line b. A further adjustment reduces the brake specific fuel consumption to 360 g/PS$_e$h as represented by line c in FIG. 6. As is evident, adjustments of the valve timing by the adjustment devices 6 can result in substantial reduction in fuel consumption. It should be noted that the point indicated by reference character x in FIG. 6 corresponds to operation at maximum rpm and full load. The advantage of the potential for adjusting the timing as effected by the internal combustion engines of the present invention can be seen from the fact that in present industrial engines the timing is generally determined so as to discharge the maximum quantity of burned gases and to introduce the maximum quantity of air at maximum rpm and full load. In some cases, valve timing is set on the basis of the half-load regions. Generally speaking, whether an engine is a high-speed type of a low-speed type is mainly dependent on the design point of the timing of each of the valves so that prior art internal combustion engines each have an optimum value for maximum rpm and full-load according to operating conditions. For example, in the vicinity of the half-load region, valve overlap is increased by about 60° and the combustion temperature, in turn, is lowered, in order to decrease the amount of nitrogen oxides in the exhaust gases. However when the engine is idling, because of the fact that at no load it runs at the low speed of 600 to 1,000 rpm and a low combustion temperature, a large overlap of the valves would incur an undesirable increase in fuel consumption.

In the internal combustion engine in accordance with the first embodiment of the invention, reduction in fuel consumption is achieved by controlling the valve timing according to such operating conditions as the intake vacuum or the opening angle of the throttle valve as aforenoted.

Figure 7:
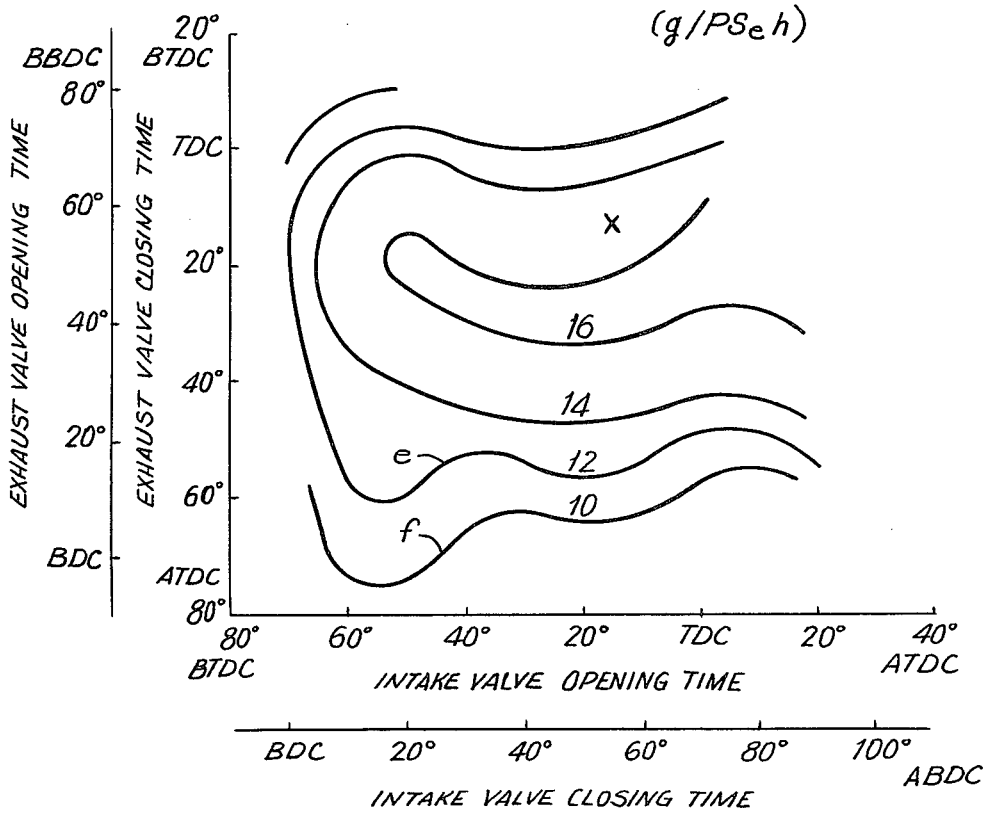

FIG. 7 shows the amount of nitrogen oxides contained as detrimental components in exhaust gases discharged from the internal combustion engine of the first embodiment of the invention provided with the adjusting device 6 in the given operating region at 2,000 rpm and full load. The tming at which the intake valve is brought to open or closed position is plotted on the abscicca, and the timing at which the exhaust valve is brought to open or closed position is plotted on the ordinate. In the internal combustion engine, the amount of nitrogen oxides contained in exhaust gases per unit hour and unit brake horsepower is 15 g/PS$_e$h as represented by x in FIG. 7. By controlling the timing at which the intake valve 31 and the exhaust valve 41 are brought to an open or closed position and the valve overlap of each valve by means of the adjusting device 6, the amount of nitrogen oxides contained in exhaust gases is reduced to 12 g/PS$_e$h as represented by the line e, and further to 10 g/PS$_e$h as represented by the line f.

Figure 16:
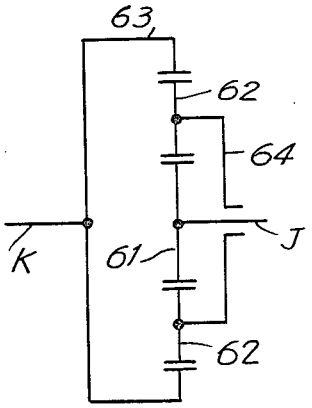
FIGS. 16–20 show diagrammatically drive arrangements in accordance with the present invention connecting a crankshaft with a camshaft.

In the first embodiment, the phase-controlling function is carried out by the planetary gear train and also the speed-reducing function is carried out to provide a reduction ratio of ½ by setting the gear ratios between each gear of the planetary gear train. In addition, a separate mechanism can carry out the speed-reducing function in combination with the planetary gear train. For example, the planetary gear train merely carries out the phase-controlling function and by disposing a predetermined gear train between the crank shaft K and the input shaft of the planetary gear train, the combination of the planetary gear train and the disposed predetermined gear train reduces the speed of the cam shaft to one half that of the crank shaft. Also in the first embodiment, the sun gear is driven by the crank shaft and the internal gear transmits its rotation to the cam shaft and the planet gears are rotatably supported and connected to the first external force-receiving means. In addition, the planetary gear train may be constructed with other combinations of a sun gear, planet gears and an internal gear as shown diagrammatically in FIGS. 16, 17, 18, 19 and 20, each gear being represented by a vertical line terminating at both ends in short borizontal lines representing gear teeth. Thus, in the planetary gear train as shown in FIG. 16, the internal gear 63 is mounted for rotating in synchronism with the crank shaft K, the sun gear 61 is mounted so as to transmit its rotation to the cam shaft J and the planet gears 62 are turned around the sun gear 61 along the inner periphery of the internal gear 63 by the first external force-receiving means provided in association with the planet gears 62. According to this planetary gear train, valve timing of the intake valve and the exhaust valve and the reduction of the speed ratio of the cam shaft J to the crank shaft K can be controlled.

Figure 17:
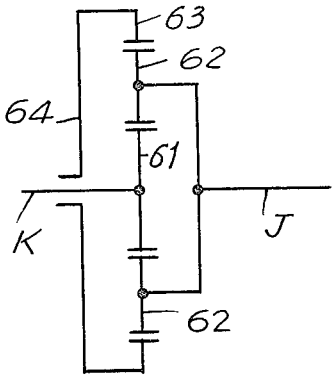

In the planetary gear train as shown in FIG. 17, the sun gear 61 is mounted for rotating in synchronism with the crank shaft K, the planet gears 62 are mounted so as to transmit their rotations to the cam shaft J and the internal gears 63 is turned relative to the sun gear 61 and the planet gears 62 by the first external force-receiving means provided in association with the internal gear 63. By means of this gear train, almost the same operational effect as that described above can be obtained.

Figure 18:
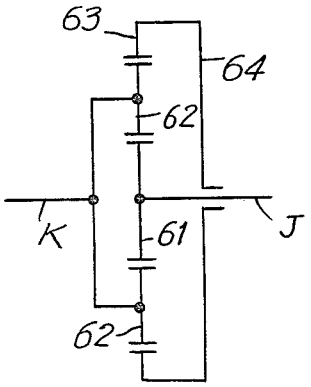

In the planetary gear train as shown in FIG. 18, the planet gears 62 are mounted for rotating in synchronism with the crank shaft K, the sun gear 61 is mounted so as to transmit its rotation to the cam shaft J and the internal gear 63 is turned relative to the sun gear 61 and the planet gears 62 by the first external force-receiving means provided in association with the internal gear 63. With this gear train, almost the same operational effects as those described above can be obtained.

Figure 19:
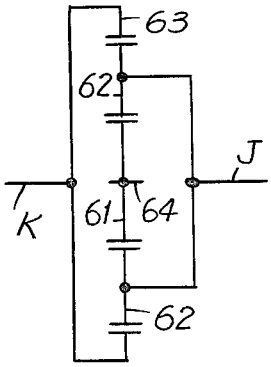

In the planetary gear train as shown in FIG. 19, the internal gear 63 is mounted for rotating in synchronism with the crank shaft K, the planet gears 62 are mounted so as to transmit their rotation to the cam shaft J and the sun gear 61 is turned relative to the internal gear 63 and the planet gears 62 by the first external force-receiving means provided in association with the sun gear 61. Again, with this gear train, almost the same operational effects as those described above can be obtained.

Figure 20:
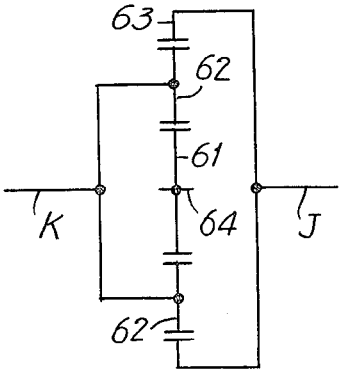

Finally, in the planetary gear train as shown in FIG. 20, the planet gears 62 are mounted for rotating in synchronism with the crank shaft K, the internal gear 63 is mounted so as to transmit its rotation to the cam shaft J and the sun gear 61 is turned relative to the internal gear 63 and the planet gear 62 by the first external force-receiving means provided in association with the sun gear 61. Once more, with this gear train, almost the same operational effects with those as described above can be obtained.

Also, the exteral force-receiving means can also control the rotational phase of the cam shaft to the crank shaft by manual setting in accordance with an operating condition of the engine.

Further, in the first embodiment, the present invention is shown as applied to a four-cylinder engine. In addition the present invention can be applied to 2, 3, 4, 5, 6 and 8-cylinder engines with the same operational effects. FIGS. 1, 2, 3, 8 and 9 are to be considered as representing engines 1 to 6 and 7 cylinders.

Figure 10:
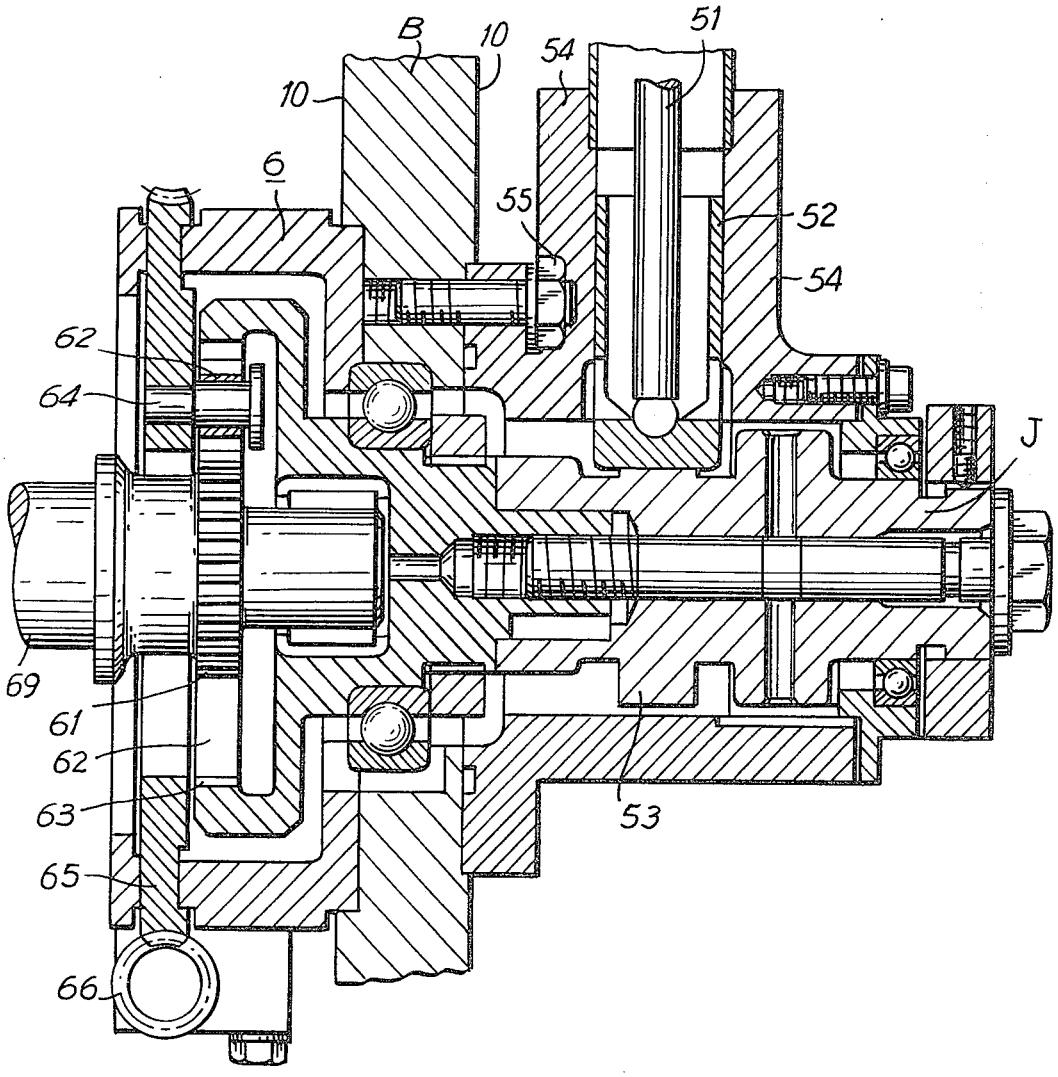

FIGS. 8–10 show a vertical type water-cooled, single cylinder four-cycle engine according to the second embodiment of the invention. Components common to those in the first embodiment are identified by the same reference numerals, and no further description is given herein.

Represented by the reference character A is a support having a smooth horizontal surface 1, and by character B are spacedapart support members having a smooth reference plane 10, the support members being removably secured to the horizontal surface 1 and extending vertically in parallel to each other. Between neighboring support members B are disposed a cylinder block C, a piston P in said cylinder block, and a cylinder head H, with the axis of a cylinder h maintained in parallel to the reference plane 10 of the support member. The crank shaft K and the cam shaft J interlocking by way of timing chain 11 with the crank shaft K are supported, with their horizontal axes displaced from each other in a vertical direction with respect to the reference plane 10, thus constituting the engine body. A cam housing 54 is disposed in the outer periphery of the cam shaft J coaxially and attached by a fixing means 55 to the wall portion of one support member B so as to pivotally move about the axis of the cam shaft J in order to adjust an acting angle of a push rod according to the inclination and placement of each valve. Within the cam housing 54 is fitted a push rod 51 in a manner to effect a reciprocating motion in the axial direction thereof. Each valve-operating device 5 thus cause each cam shaft J interlocking with crank shaft K to bring intake valve 31 or exhaust valve 41 to an open or closed position at a given acting angle by way of each valve lifter 52, push rod 51 and rocker arm 50 (FIG. 9).

This planetary gear train constitutes a reduction gear device for cam shaft J, wherein the reduction ratio, more specifically the gear ratio of the sun gear 61 to the internal gear 63 is ½. Reference numerals 7 indicate balance shafts which are disposed in equi-spaced relation to the crank shaft K between support members B of the engine, as seen in FIGS. 8 and 9, in a manner such that one of balance shafts 7 is rotated in the same direction as the crank shaft K by way of a timing chain 71, and the other balance shaft K is rotated in the opposite direction. A weight 71 (FIG. 8) is mounted on each balance shaft so as to provide the equilibrium of a primary inertia generated due to kinetic mass, such as of a piston P and the crank shaft K produced by the running of the engine. A lubricating system 8, holds a lubricating oil the temperature of which is maintained constant by a control tank (not shown) provided externally of the system, and which is adjusted in pressure and distributed to moving portions of the engine. This lubricating system 8 is of the dry-sump type, in which transportation pumps are provided in the oil supply side and the oil discharge side, without a lubricating oil pan, so that stable and desired lubrication conditions may be consistently provided. A cooling system 9 cools the cylinder head H and the cylinder block C by water independently from each other. The temperature of the cooling water is controlled by a control tank (not shown) provided externally of the system, so as to maintain the cooling water at a constant temperature, and the cooling water is then adjusted in pressure and distributed to the portions of the engine to be cooled. This cooling system system constantly provides desired and stable cooling conditions, as well as a wall temperature condition and is suited for the interchange of cylinder heads H. In the internal combustion engine according to the second embodiment, a fuel supply system F and an ignition system V both being indicated schematically are adjustable separately and independently of the operating of the engine.

In order to match the direction of the sliding movement of the valve lifter 52 in each valve operating device 5 with the inclination of the push rod 51, cam housings 54 for intake valve 31 and exhaust valve 41 are rotatable about the axes of cam shafts J by unfastening the fixing means from the support members B, so that the acting angle of the cam 53 of each cam shaft J with respect to the intake valve 31 or the exhaust valve 41 will change in phase. The timing at which the valves are brought to an open or closed position is adjusted with ease and accuracy by operating the adjusting device with any type intake or exhaust valve regardless of inclination and positioning thereof. The adjusting device 6, where the planet gear 62 is maintained fixed, reduces the speed of the sun gear 61 mounted on the timing shaft 69 driven in synchronism with the shaft K to the valve equal to the speed of the internal gear 63 directly connected to the cam shaft J. In more detail, if the planet gear 62 is rotated through $\theta_P$ as in the preceding embodiment, then the internal gear 63 of the cam shaft J will be rotated through $O_R$ relative to sun gear 61. Thus, the phase of the cam shaft J with respect to the crank shaft K is freely changeable through 360° during the operation of the engine.

The timing at which intake valve 31 and exhaust valve 41 are brought to open or closed position and the overlap of each valve may be changed by rotating the worm gear 65 and hence the planet gear 62 meshing therewith, and hence the phase of the internal gear 63, so that the phase of the cam shaft J associated therewith may be changed. The timing of the intake valve 31 and the exhaust valve 41 may be set independently from each other, and an opening period of each valve being overlapped may be increased or decreased. This permits the interchange of combustion chambers of different configuration. Included in the types of overhead valve type combustion chambers are semi-spherical shaped (FIG. 12), pan-cake shaped (FIG. 11), bath-tub shaped (FIGS. 22*a* & 22*b*), and wedge-shaped combustion chambers (FIGS. 21*a* & 21*b*).

Figure 12:
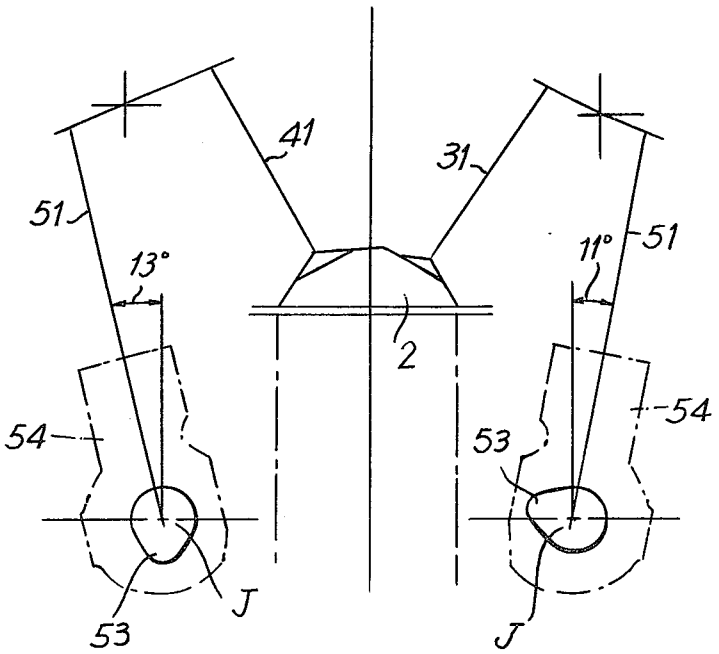
FIGS. 11 and 12 are schematic diagrams showing the modes of exchange between combustion chambers of different configurations in the internal combustion engine according to the second embodiment.
Figure 11:
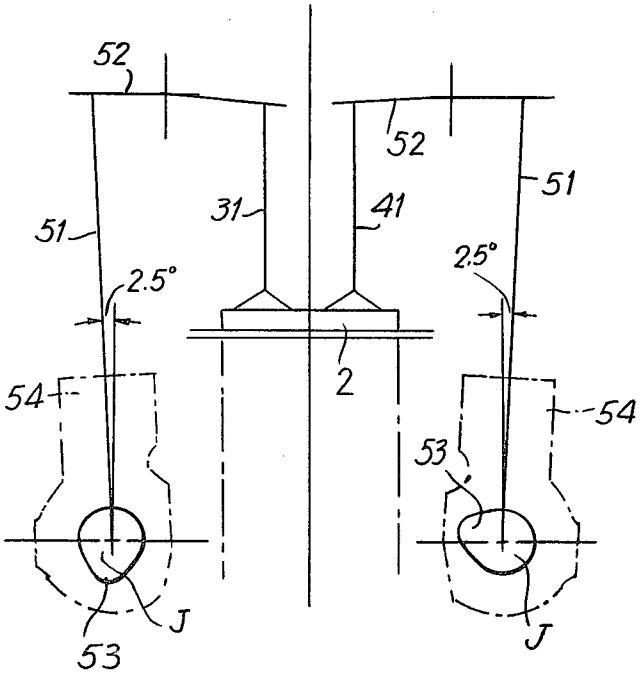

In the internal combustion engine according to the second embodiment, interchange between the combustion chambers of the above-mentioned configurations is possible for the investigation of the effects of valve inclination and valve positioning. The configuration of the combustion chamber is selected according to the object and application of the internal combustion engine. The interchange of a pan-cake shaped chamber and a semi-spherical shaped combustion chamber will be explained as an example. FIGS. 11 and 12 show the relationships among valve inclination, valve positioning and the acting point of a cam in the pan-cake-shaped combustion chamber and the hemispherical-shaped combustion chamber, respectively. The configuration of the combustion chamber can be changed from a pan-cake shape (FIG. 11) to a semi-spherical shape (FIG. 12), by inclining the intake valve 31 by 11° to the right with respect to the axis of the combustion chamber, and inclining the exhaust valve 41 by 13° to the left with respect to the axis of the combustion chamber, respectively. Thus, the interchange of combustion chambers of different configuration is achieved with ease and accuracy of the aforedescribed operation. The interchange of the combustion chambers results in the change in the height of the cylinder head H and in the compression ratio and stroke. Change in these factors requires change in the inclination and length of the push rod 51, and in the acting point of the cam. The valve-operating device 5 and the valve-closing and opening adjusting device 6, make it possible to meet these requirements. In the internal combustion engine according to the second embodiment, the valve timing and the valve lift of each valve can be changed by replacing the cam shaft by another having a different cam profile.

If the fixing means of the cam housing 54 is unfastened, the cam shaft J is readily demounted from the cam housing 54, with the internal gear 63 on the cam shaft J maintained fixed to the support member B. Another cam shaft of a different cam profile can then be mounted in the cam housing 54 by inserting a bolt serving as a fixing means through the cam shaft, inserting it in the cam housing 54 and firmly bolting it thereto.

Balance shafts 7 can balance with the primary inertia generated by the kinetic mass of piston P or crank shaft K which causes vibration. In this internal combustion engine, two balance shafts 7 are disposed at an equispacing from crank shaft K in a manner such that one shaft is rotated at the same rate as the crank shaft, and the other shaft is rotated in a reverse phase to that of crank shaft K, so that the aforesaid primary inertia may be well balanced, and the vibration of the engine can be adsorbed with high efficiency, thereby stabilizing the engine operation with little or no vibration.

Figure 13:
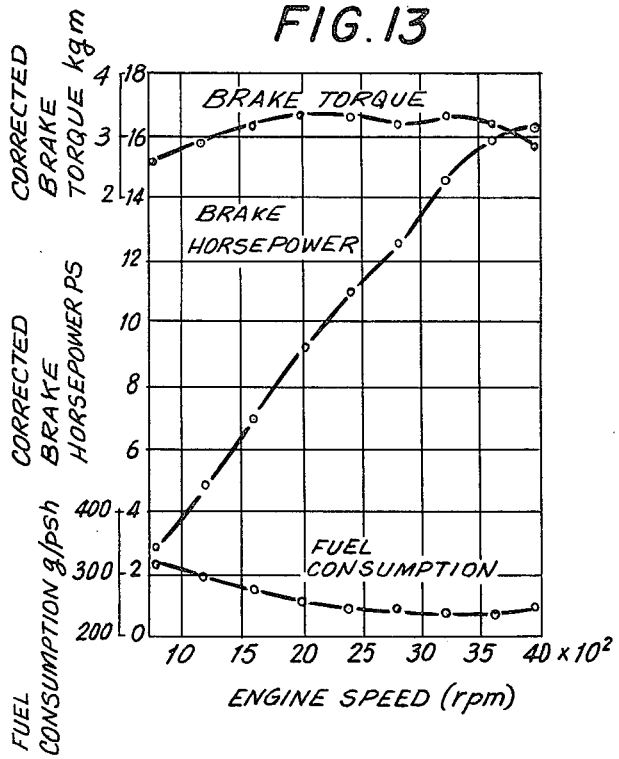
FIGS. 13 and 14 are line graphs showing respectively performance at full open throttle, and the mean effective pressure in an internal combustion engine of the second embodiment.
Figure 14:
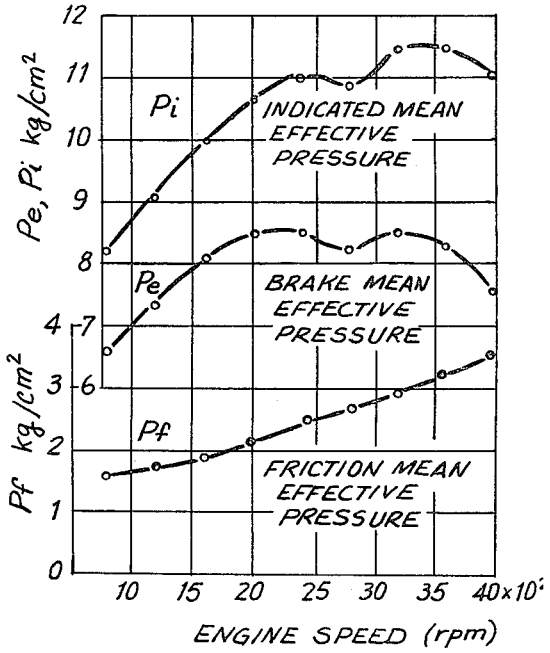

The internal combustion engine according to the second embodiment, when used for testing purposes, achieves performance as plotted in FIG. 13. In this drawing, the speed of the engine is plotted along the abscicca axis, and fuel consumption brake horsepower and brake torque are plotted on the ordinate axis. From this Figure it can be seen that the maximum torque is 3.2 kgm, the maximum brake horsepower is 16.2 ps, and the minimum fuel consumption is 240 g/PS$_e$h, and that the engine achieves the output performance to the full, yielding satisfactory results from the practical viewpoint. The friction mean effective pressure of the internal combustion engine of the second embodiment is 2.1 kg/cm$^2$/2000 rpm, as shown in FIG. 14 by plotting brake speed on the abscissa and plotting the mean effective pressure on the ordinate. Comparison of this friction means effective pressure of the internal combustion engine of this embodiment with that of a prior art, single-cylinder engine for testing use shows that the former is much lower over the entire operating region. Also, the slope relative to the engine speed is fairly gentle. Thus, the internal combustion engine of the second embodiment quite evidently shows reliable and practical performance. From this, it is understood that the provision of the valve operating devices 5 and the adjusting device 6 in the internal combustion engine does not incur any increase in friction. The internal combustion engine may be operated in the range of 500 to 4,000 rpm without any trouble or vibration, thus achieving its objectives to the full.

In the second embodiment, the present invention may be applied to single cylinder engines. In addition, the present invention can be applied to 2, 3, 4, 5, 6 and 8 cylinder engines and the same operational effects as the second embodiment can be achieved thereby. Also, FIGS. 8–12 and 15 are to be regarded as representing engines having any of 1–6 or 8 cylinders.

The internal combustion engine according to the second embodiment provides constant and accurate performance under the fixed conditions for a long period and at the same time, yields the following practically significant results.

The internal combustion engine is mounted between the support members vertically attached to the horizontal support for facilitating the mounting or demounting thereof. This structure provides for easy and accurate remodelling of the engine in a series of tests or analyses for the development of an engine, and provides an engine having a tough and stable construction. Furthermore, almost all the moving portions and interchangeable portions are arranged so as to readily examined and overhauled and for maintenance. Therefore, the labor for such purposes can be minimized.

Bearing portions or sliding portions have strong constructions and shapes against deformation, so that there are constantly obtained a stable friction loss value as well as an improved interchangeability of parts.

The temperature, pressure and flow rate of a lubricating oil and cooling water are controllable from the exterior of the system, so that the desired lubricating conditions may be set during the operating of the engine and maintained constant for that duration.

The adjustable ranges of cylinder bore and stroke, and the speed of the engine are very wide and the compression ratio can be greatly increased.

Figure 15:
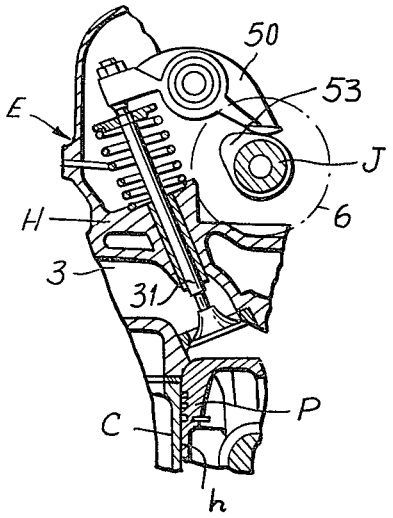
FIG. 15 is a cross-sectional view of the essential parts of an internal combustion engine according to a further embodiment.

In the internal combustion engines according to the embodiments of the present invention, the valve-operating device is an overhead cam shaft type (OHC) and an overhead valve type (OHV). In addition, the valve-operating device 5 and the adjusting device 6 may take an overhead cam shaft type such as a seesaw-shaped rocker type as shown in FIG. 15 or a finger-shaped rocker type as shown in FIG. 23.

In such a type, the cam shafts which are disposed in cylinder head H operate the intake valve 31 and the exhaust valve 41 by way of rocker arms 50, so that there can be achieved the same operational results as those of the preceding embodiments, by control of the acting angles of the cam shafts with respect to the intake valve 31 and the exhaust valve 41, valve timing of the intake valve 31 and the exhaust valve 41, valve overlap of each valve and reduction ratio of each cam shaft to the crank shaft K. The internal combustion engine according to the present invention is applicable to a single cylinder in-line or valve-attached, two-cycle gasoline engine or diesel engine, with the same operational results as described above.

As described above, according to the internal combustion engine of the present invention, the phase of each cam shaft relative to the crank shaft is adjusted by the valve-operating mechanism comprising an adjusting device for use in adjusting the opening and closing timing of each valve and reducing the rotational speed of the cam shaft to the crank shaft.

According to the present invention, there is provided a valve-operating mechanism capable of freely setting and changing the timing at which the intake valve and the exhaust valve are brought to an open or closed position, an opening period of each valve being overlapped, and a reduction ratio of the speed of a cam shaft to a crank shaft even during the operation of the engine, so that the fuel consumption as well as the amount of nitrogen oxides contained in exhaust gases in a given operating region of the engine may be reduced to maximum extent. Furthermore, according to the present invention, reduction in speed ratio of a cam shaft to a crank shaft is attained efficiently and accurately, as well as reduction in size of the device and simplicity in construction are realized. Thus, the internal combustion engine of the present invention can be used as a practical engine having satisfactory performance.

The internal combustion engine according to the present invention comprises, in addition to the adjusting device, a valve-operating device which allows a change in the angle of each cam shaft acting on an intake valve and an exhaust valve about the axis of the cam shaft, so that the intake valve and the exhaust valve may be closed or opened at a given acting angle, so that cylinders different in valve inclination and valve placement are mutually interchangeable, and a combustion chamber of a configuration suited for the object and application can be employed. Therefore, the internal combustion engine of the present invention can be employed for test use in developing a new engine.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. An internal combustion engine comprising:

a cylinder block having at least one cylinder, a piston reciprocably disposed within said cylinder, a combustion chamber formed by the inner wall of said cylinder and a face of said piston, an intake valve and an exhaust valve for respectively supplying air-fuel mixture into said combustion chamber and discharging burnt gases from said combustion chamber at predetermined timings;

an intake cam shaft and an exhaust cam shaft, each shaft having a cam thereon, said shafts being driven in association with a crank shaft for opening and closing said intake valve and said exhaust valve respectively at said predetermined timings, an adjusting device including at least two individual planetary gear trains one gear train being associated with each said cam shaft, each said gear train, comprising a sun gear, planet gears, an internal gear and a carrier for rotatably supporting said planet gears and for rotating said planet gears around said sun gear along the inner pheriphery of said internal gear, a first element of said sun gear, said internal gear and said carrier of each said gear train being coupled for rotation in synchronism with said crank shaft, a second element of each said gear train providing for transmitting the rotation to said associated cam shaft, and the third element being rotatably supported, and a first and second external force-receiving means provided in association with each said third element for turning said third element relative to said first and second element by a predetermined angle and maintaining the position of said third element, thereby changing independently the rotational phase of said cam shafts with respect to said crank shaft for independently adjusting the timing at which said intake valve and said exhaust valve are brought to an open or closed position;

two valve operating devices, each device comprising:

a cam housing disposed in the outer periphery of said cam shaft coaxially and attached by a fixing means to the engine so as to pivotally move about the axis of said cam shaft, and an interlocking portion including a valve lifter connected to a cam on said cam shaft within said cam housing, a push rod connected to said valve lifter and reciprocably fitted in said cam housing and a rocker arm connecting said push rod and said intake valve or exhaust valve, two balance shafts disposed in equi-spaced relation from said crank shaft and each including a mounted weight, one of said two balance shafts being connected to said crank shaft through said timing chain and rotating in the same direction as that of said crank shaft, the other balance shaft rotating in the opposite direction to that of said crank shaft, an injection-adjusting device including a planetary gear train comprising a sun gear, three planet gears, an internal gear and a carrier rotatably supporting said planet gears for rotating the same around said sun gear along the inner periphery of said internal gear, said sun gear being driven in synchronism with said crank shaft through said timing shaft by said chain means, said internal gear being coupled with said injection pump shaft integrally and said carrier being rotatably supported and a second external force-receiving means for adjustment of injection timing comprising:

a worm wheel integrally formed on said carrier in its outer periphery and, a worm gear engaging said worm wheel, and a link and cable connecting said device with said worm gear for turning said planet gears about said sun gear by a predetermined angle and maintaining the same fixed, and an ignition adjusting device including a planetary gear train comprising a sun gear, three planet gears, an internal gear and a carrier rotatably supporting said planet gears and rotating the same around said sun gear along the inner periphery of said internal gear, a chain means for driving said sun gear in synchronism with said crank shaft through said timing shaft, said internal gear being coupled with said ignition-adjusting device shaft integrally and said carrier being rotatably supported, and a third external force-receiving means for adjustment of ignition timing comprising:

a worm wheel integrally formed on said carrier in its outer periphery.

2. An internal combustion engine comprising:

a cylinder block having at least one cylinder, a piston reciprocably disposed within said cylinder, a combustion chamber formed by the inner wall of said cylinder and a face of said piston, an intake valve and an exhaust valve for respectively supplying air-fuel mixture into said combustion chamber and discharging burst gases from said combustion chamber at predetermined timings;

an intake cam shaft and an exhaust cam shaft, each shaft having a cam thereon, said shafts being driven in association with a crank shaft for opening and closing said intake valve and said exhaust valve respectively at said predetermined timings, an adjusting device including train means being associated with each said cam shaft, a first element of said train means being coupled for rotation in synchronism with said crank shaft, a second element of said train means providing for transmitting the rotation to said associated cam shaft, and a third element being rotatably supported, and a first and second external force-receiving means provided in association with said third element for turning said third element relative to said first and second element by a predetermined angle and maintaining the position of said third element, for changing independently the rotational phase of said cam shafts with respect to said crank shaft for independently adjusting the timing at which said intake valve and said exhaust valve are brought to an open or closed position;

an injection-adjusting device including a planetary gear train comprising a sun gear, three planets gears, an internal gear and a carrier rotatably supporting said planet gears and rotating the same around said sun gear along the inner periphery of said internal gear, a chain means for driving said sun gear in synchronism with said crank shaft through said timing shaft, an injection pump shaft integrally coupled with said internal gear and said carrier being rotatably supported and, a second external force-receiving means for adjustment of injection timing comprising:

a worm wheel integrally formed on said carrier in its outer periphery, a worm gear engaging said worm wheel, a link and a cable for turning said planet gears about said sun gear by a predetermined angle and maintaining the same fixed, an operating-condition detecting and controlling device connected with said worm gear through said link and cable, an ignition-adjusting device including a planetary gear train comprising a sun gear, three planet gears, an internal gear and a carrier rotatably supporting said planet gears and rotating the same around said sun gear along the inner periphery of said internal gear, a chain means for driving said sun gear in synchronism with said crank shaft through said timing shaft, an ignition device shaft coupled integrally with said internal gear and said carrier being rotatably supported, and a third external force receiving means for adjustment of ignition timing comprising:

a worm wheel integrally formed on said carrier in its outer pheriphery and, a worm wheel connected to an operating-condition detecting device through a link and a cable and turning said planet gears about said sun gear by a predetermined angle and maintaining the same fixed, wherein said engine is an overhead cam shaft type four-cylinder four-cycle gasoline engine.

3. An internal combustion engine comprising:

a cylinder block having at least one cylinder, a piston reciprocably disposed within said cylinder, a combustion chamber formed by the inner wall of said cylinder and a face of said piston, an intake valve and an exhaust valve for respectively supplying air-fuel mixture into said combustion chamber and discharging burnt gases from said combustion chamber at predetermined timings;

an intake cam shaft and an exhaust cam shaft, each shaft having a cam thereon, said shafts being driven in association with a crank shaft for opening and closing said intake valve and said exhaust valve respectively at said predetermined timings, an adjusting device including train means being associated with each said cam shaft, a first element of said train means being coupled for rotation in synchronism with said crank shaft, a second element of said train means providing for transmitting the rotation to said associated cam shaft, and a third element being rotatably supported, and a first and second external force-receiving means provided in association with said third element for turning said third element relative to said first and second elements by a predetermined angle and maintaining the position of said third element, for changing independently the rotational phase of said cam shafts with respect to said crank shaft for independently adjusting the timing at which said intake valve and said exhaust valve are brought to one of an open and closed position;

valve-operating means for adjusting independently the acting angles of said cam shafts to said intake valve and exhaust valve, whereby said intake valve and exhaust valve may each be independently brought to one of an open and closed position at a selected acting angle of said cam shaft;

said valve operating means comprises an interlocking portion having two ends one end of which is in engagement with one of said intake valve and exhaust valve, and a cam housing retaining said interlocking portion in a manner to allow the reciprocating motion thereof, said housing being secured to the engine body pivotally about the axis of said cam shafts, thereby providing for turning said cam housing about the axis of said cam shaft by a predetermined angle, adjusting an engaging point of said interlocking portion with said cam and with one of said intake valve and exhaust valve and controlling an acting angle of said cam shaft with respect to said intake valve and said exhaust valve.

4. An internal combustion engine according to claim 3, further comprising an ignition adjusting device including an ignition device shaft, a planetary gear train comprising a sun gear, planet gears, an internal gear and a carrier for rotatably supporting said planet gears and for rotating the same around said sun gear along the inner periphery of said internal gear, a first element of said sun gear, said internal gear and said carrier being drivable in synchronism with said crank shaft, a second element connected for transmitting the rotation to said ignition-device shaft, and the third element being rotatably supported, and a third external force-receiving means provided in association with said third element for turning same relative to said first and second elements through a predetermined angle and maintaining the position of said third element, thereby providing for changing the rotational phase of said ignition-device shaft with respect to said crank shaft and for adjusting ignition timing.

5. An internal combustion engine according to claim 3, wherein said cam shaft is removably mounted in said engine so that it is interchangeable with another one provided with another cam profile, thereby providing for changing a valve acting angle and a valve lift in accordance with the change of said cam shaft.

6. An internal combustion engine according to claim 3, wherein each of said gears has a predetermined number of teeth in accordance with a desired reduction ratio, thereby setting gear ratios between said gears in accordance with said desired reduction ratio, and reducing the rotational speed of said cam shafts relative to said crank shaft in said desired reduction ratio.

7. An internal combustion engine according to claim 6, wherein said internal combustion engine of four cycles has not more than 8 cylinders.

8. An internal combustion engine according to claim 6, wherein said internal combustion engine is a single cylinder engine, further comprising balance shafts associated with said crank shaft for balancing the primary inertia generated due to the kinetic mass of said components of said engine, thereby absorbing the vibration of the engine and stabilizing the engine operation.

9. An internal combustion engine according to claim 3, further comprising fuel injection pump means including an injection pump shaft connected for supplying fuel to said cylinder, an injection adjusting device including a planetary gear train comprising a sun gear, planet gears, an internal gear and a carrier rotatably supporting said planet gears and rotating the same around said sun gear along the inner periphery of said internal gear, a first element of said sun gear, said internal gear and said carrier being driven in synchronisn with said crank shaft, a second element transmitting the rotation to said fuel injection pump shaft, and the third element being rotatably supported, and a second external force receiving means provided in association with said third element for turning said third element relative to said first and second elements through a predetermined angle and maintaining the position of said third element, thereby providing for changing the rotational phase of said pump shaft with respect to said crank shaft and for adjusting injection timing.

10. An internal combustion engine according to claim 9, further comprising an ignition-adjusting device including an ignition device shaft, a planetary gear train comprising a sun gear, planet gears, an internal gear and a carrier rotatably supporting said planet gears and rotating the same around said sun gear along the inner periphery of said internal gear, a first element of said sun gear, said internal gear and said carrier being drivable in synchronism with said crank shaft, a second element connected for transmitting the rotation to said ignition device shaft, and the third element being rotatably supported, and a third external force receiving means provided in association with said third element for turning said third element relative to said first and second elements by a predetermined angle and maintaining the position of said third element, thereby providing for changing the rotational phase of said ignition-device shaft with respect to said crank shaft and for adjusting ignition timing.

11. An internal combustion engine according to claim 10, further comprising a valve-operating device comprising an interlocking portion having two ends, one end of which is engaged with a cam on said cam shaft and the other end of which is engaged with one of said intake valve and exhaust valve, thereby providing for adjusting of an engaging point of said interlocking portion with said cam and with one of said intake valve and exhaust valve, and for controlling the acting angle of said cam shaft with respect to one of said intake valve and said exhaust valve.

12. An internal combustion engine according to claim 11, wherein said internal combustion engine is an overhead valve type engine and a combustion chamber of said engine is interchangeable among a pan-cake shaped, semi-spherical shaped, bath-tub shaped, and wedge-shaped combustion chamber.

13. An internal combustion engine according to claim 3, wherein said train means includes a planetary gear train comprising a sun gear, planet gears, an internal gear and a carrier for rotatably supporting said planet gears and for rotating the same around said sun gear along the inner periphery of said internal gear, each of said gears has a predetermined number of teeth in accordance with a desired reduction ratio, thereby setting gear ratios between said gears in accordance with said desired reduction ratio for reducing the rotational speed of said cam shaft to said crank shaft in said desired reduction ratio.

14. An internal combustion engine according to claim 13, further comprising detection and manual control means connecting with said first external force-receiving means for manual adjustment of the rotational phase of said cam shafts relative to that of said crank shaft in accordance with the operating condition of said internal combustion engine..

15. An internal combustion engine according to claim 13, further comprising detection and automatic control means connecting with said first external force-receiving means for automatic adjustment of the rotational phase of said cam shafts to that of said crank shaft in accordance with the operating condition of said internal combustion engine.

16. An internal combustion engine according to claim 14 or 15, wherein said operating condition is at least one operating condition selected from the group consisting of an opening angle of a throttle valve, a level of intake vacuum, rotational speed, exhaust gas temperature, engine load and the kind and the quantity of detrimental components contained in exhaust gases.

17. An internal combustion engine according to claim 13, wherein in each said gear train said carrier is rotatably supported, with said sun gear being arranged and constructed for being driven in synchronism with said crank shaft, and with said internal gear serving for transmitting the rotation to said associated cam shaft.

18. An internal combustion engine according to claim 17 and further comprising a valve operating device comprising an interlocking portion of which one end is engaged with one end of a cam on said cam shaft and the other end is engaged with one of said intake valve and exhaust valve, thereby adjusting an engaging point of said interlocking portion with said cam and that with one of said intake valve and exhaust valve and controlling an acting angle of said cam shaft with respect to said intake valve and said exhaust valve.

19. An internal combustion engine according to claim 17, comprising, two separate cam shafts for operation of said intake and exhaust valve, two separate planetary gear trains for operating said separate cam shafts, a timing shaft and a timing chain connecting said timing shaft with said gears in said planetary gear trains for driving said sun gears in synchronism with said crank shaft, the internal gear in each train being integrally coupled with a cam shaft, the number of planet gears in each train being three, and two force-receiving means for adjusting individually the phase of each cam shaft relative to that of said crank shaft, the gear ratio of each sun gear to its associated internal gear being $\frac{1}{2}$.

* * * * *